US009193422B1

(12) United States Patent
Neumann

(10) Patent No.: US 9,193,422 B1
(45) Date of Patent: Nov. 24, 2015

(54) SELF-RESETTING AUTOMATIC CABLE CUTTER

(71) Applicant: Exelis Inc., McLean, VA (US)

(72) Inventor: Nels N. Neumann, Lynn Haven, FL (US)

(73) Assignee: Exelis Inc., Herndon, VA (US)

( * ) Notice: Subject to any disclaimer, the term of this patent is extended or adjusted under 35 U.S.C. 154(b) by 28 days.

(21) Appl. No.: 14/163,102

(22) Filed: Jan. 24, 2014

(51) Int. Cl.
*B63G 7/04* (2006.01)
*B63G 7/02* (2006.01)

(52) U.S. Cl.
CPC ..... *B63G 7/02* (2013.01)

(58) Field of Classification Search
USPC ..... 114/221 R, 221 A
IPC ..... B63G 7/04
See application file for complete search history.

(56) References Cited

U.S. PATENT DOCUMENTS

| | | | | |
|---|---|---|---|---|
| 2,402,057 | A * | 6/1946 | Kottmann | 114/221 A |
| 3,071,098 | A * | 1/1963 | Hinckley et al. | 114/221 R |
| 4,016,728 | A * | 4/1977 | Mason | 405/190 |
| 2010/0064523 | A1 * | 3/2010 | Claeys | 30/90.1 |

* cited by examiner

*Primary Examiner* — Stephen Avila
(74) *Attorney, Agent, or Firm* — Edell, Shapiro & Finnan LLC

(57) ABSTRACT

A self-resetting automatic cable cutter includes a body having an elongate cable slot disposed therein. The cable slot has an opening that is configured to receive a cable (wire) therein such that the cable slides along the cable slot. First and second cutting assemblies are positioned on opposing sides of the slot and a coupler is positioned across the cable slot. The coupler connects the first and second cutting assemblies together and is configured to slide away from the opening in response to force applied by the cable. The sliding of the coupler away from the opening in response to the force applied by the cable causes the first and second cutting assemblies to close together to cut the cable.

17 Claims, 13 Drawing Sheets

SELF-RESETTING AUTOMATIC CABLE CUTTER

TECHNICAL FIELD

The present general inventive concept relates to a self-resetting automatic cable cutter.

BACKGROUND

Naval/sea mines are manufactured or improvised explosive devices that are placed in waterways to destroy marine vessels, including surface ships and submarines. Although a large number of naval mines have been developed, naval mines can generally be classified as either bottom mines, buoyant moored mines, drifting mines, or limpet mines. Bottom mines are mines that are configured to rest on the bottom of a waterway and are generally triggered when in proximity to a passing vessel. Limpet mines are a special form of contact mine that are manually attached to a vessel via a magnet. Moored mines are generally buoyant, but are tethered in place by a mooring line and anchor. Floating mines are buoyant mines that float on or near the water surface, but generally remain anchored in place. Drifting mines can be positively or neutrally buoyant and are carried by currents and tides.

Naval mines may be either contact mines or influence mines. Contact mines are mines that are designed explode when placed contact with a naval vessel, while influence mines are triggered by the influence of a naval vessel, rather than direct contact. Influence mines generally include sensors (e.g., magnetic, acoustic, seismic, electrical potential, pressure, etc.) that detect when a naval vessel is in proximity to the mine.

Due to the availability and effectiveness of naval mines, mine warfare vessels (naval minesweepers or sweep vessels) are widely deployed by governments and other entities. Naval minesweepers are small naval warships equipped with some type of naval mine sweeping system that is configured to detect and disarm or safely detonate naval mines.

Naval mine sweeping systems may have a number of different configurations, depending on the type of mine that the system is designed to detect and deactivate. In the case of naval mine sweeping systems designed to detect and deactivate moored mines, the system usually includes a cable cutter connected to a sweep line. The sweep line guides the mooring line of the moored mine to the cable cutter. The cable cutter cuts/severs the mooring line so that the moored mine may float to the surface for subsequent deactivation.

SUMMARY

In accordance with embodiments presented herein, a self-resetting automatic cable cutter is provided. The self-resetting automatic cable cutter comprises an elongate body, an elongate cable slot extending along a length of the body and having an opening configured to receive a cable therein such that the cable is able to slide along the cable slot, first and second cutting assemblies disposed on opposing sides of the cable slot, and a coupler disposed across the cable slot, wherein the coupler mechanically connects to the first and second cutting assemblies and is configured to slide away from the opening in response to force applied by the cable. Sliding of the coupler away from the opening causes the first and second cutting assemblies to close together to cut the cable positioned in the cable slot.

In accordance with other embodiments presented herein, a system is provided. The system comprises a sweep line configured to engage a mooring cable and a self-resetting automatic cable cutter disposed on the sweep line so as to move relative to the mooring cable and comprising first and second cutting bars. The self-resetting automatic cable cutter is configured to receive the mooring cable therein and to use the movement relative to mooring cable to provide mechanical leverage that closes the first and cutting bars together so as to cut the mooring cable.

In accordance with other embodiments presented herein, a self-resetting automatic cable cutter is provided. The self-resetting automatic cable cutter comprises first and second slideable cutting assemblies disposed around an elongate cable slot and having first and second ends. A coupler is attached to the second ends of the first and second cutting assemblies and is configured receive a force from a cable disposed in the cable slot that causes sliding movement of the first and second cutting assemblies such that the first ends of the cutting assemblies follow a curved path resulting in closure of the first and second cutting assemblies that sever the cable sliding along the cable slot.

These and other objects, features and advantages of the present general inventive concept will be apparent from the following detailed description of illustrative embodiments thereof, which is to be read in connection with the accompanying drawings.

DESCRIPTION OF EXAMPLE EMBODIMENTS

Embodiments of the present invention are generally directed to a self-resetting automatic cable cutter. The self-resetting automatic cable cutter includes a body having an elongate cable slot disposed therein. The cable slot has an opening that is configured to receive a cable (wire) therein such that the cable slides along the cable slot. First and second cutting assemblies are positioned on opposing sides of the slot and a coupler is positioned across the cable slot. The coupler connects the first and second cutting assemblies together and is configured to slide away from the opening in response to force applied by the cable. The sliding of the coupler away from the opening in response to the force applied by the cable causes the first and second cutting assemblies to close together to cut the cable.

Self-resetting automatic cable cutters in accordance with embodiments presented herein may be used in a number of different systems and arrangements. Merely for ease of illustration, embodiments will be described herein with reference to self-resetting automatic cable cutters forming part of a naval mine sweeping system to cut cables associated with moored naval (sea) mines. It is to be appreciated that a self-resetting automatic cable cutter in accordance with embodiments presented herein may also used to, for example, cut cables in enclosed environments, cut cables in contaminated environments, etc.

Figure 1:
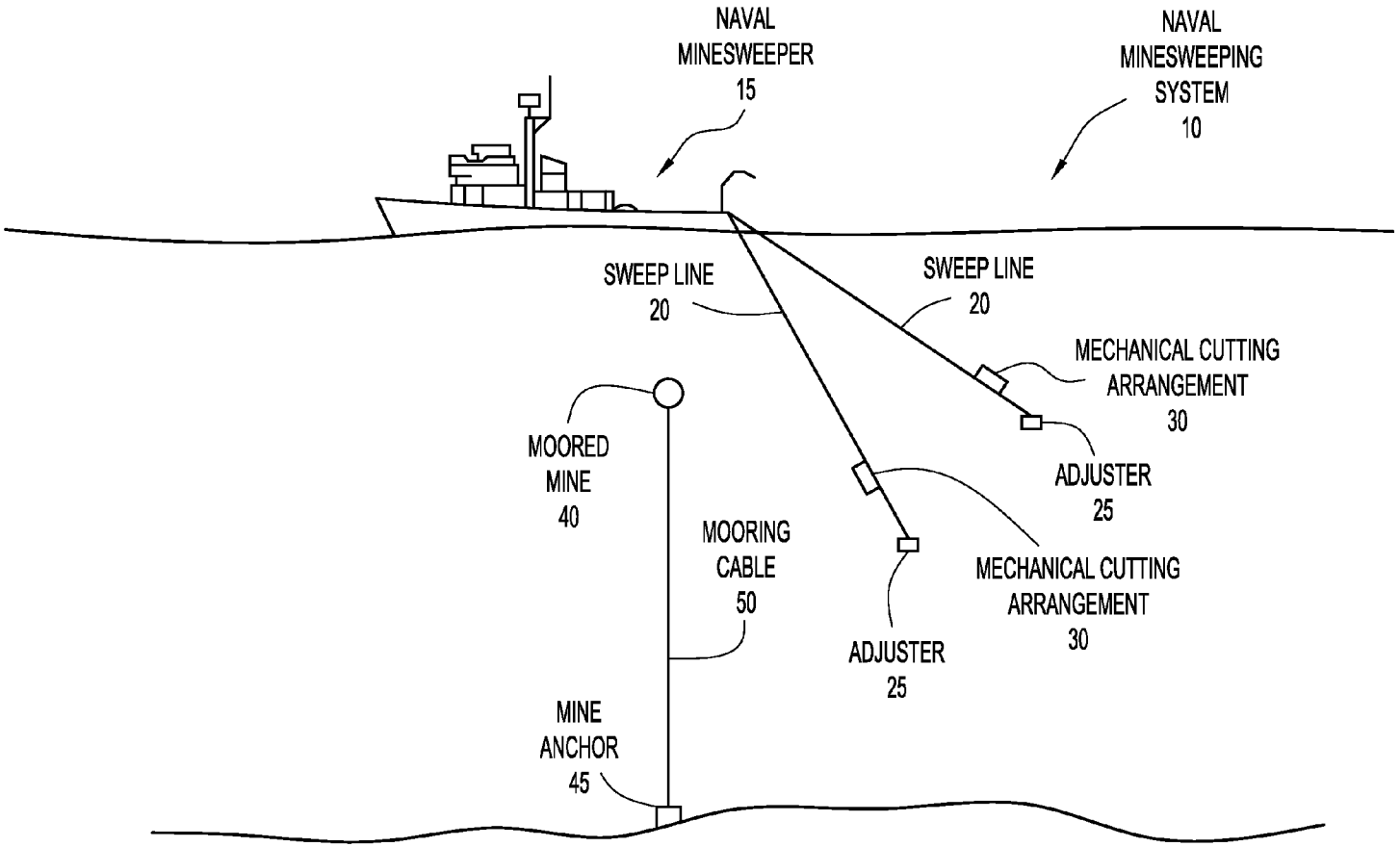
FIG. 1 is a schematic diagram illustrating a naval mine sweeping system that comprises self-resetting automatic cable cutters in accordance with embodiments presented herein.

FIG. 1 is a schematic diagram illustrating a naval mine sweeping system 10 that comprises two mechanical cutting arrangements 30 in accordance with embodiments presented herein. As shown, the naval mine sweeping system 10 is deployed by a naval minesweeper (sweep vessel) 15.

The naval mine sweeping system 10 comprises one or more sweep lines 20 that are towed (pulled) behind the naval minesweeper 15. In the embodiment of FIG. 1, the naval minesweeper 15 deploys two (2) sweep lines 20. An adjuster (depressor) 25 is positioned at the end of each sweep line 20. The adjusters 25 may be, for example, hydrodynamic devices that are configured to control the depth, orientation, etc. of the sweep lines 20. In the embodiment of FIG. 1, the adjusters 25 cause the sweep lines to collectively form a general V-shape. Each of the two mechanical cutting arrangements 30 are attached to one of the sweep lines 20.

FIG. 1 illustrates a moored mine 40 that is attached to a mine anchor 45 by a mooring cable 50. In the embodiment shown in FIG. 1, as the sweep lines 20 are towed by the naval minesweeper 15, one of the sweep lines 20 will contact with the mooring cable 50. Once the sweep line 20 makes contact with the mooring cable 50, the mooring cable 50 will slide along the sweep line 20 until it reaches the mechanical cutting arrangement 30. The mechanical cutting arrangements 30 each include a self-resetting automatic cable cutter (not shown in FIG. 1) that is configured to use the tension of the mooring cable 50 as a mechanical advantage to cut/sever the mooring cable so that the mine 40 is allowed to float to the surface (or float off) where it can be disabled.

Figure 2:
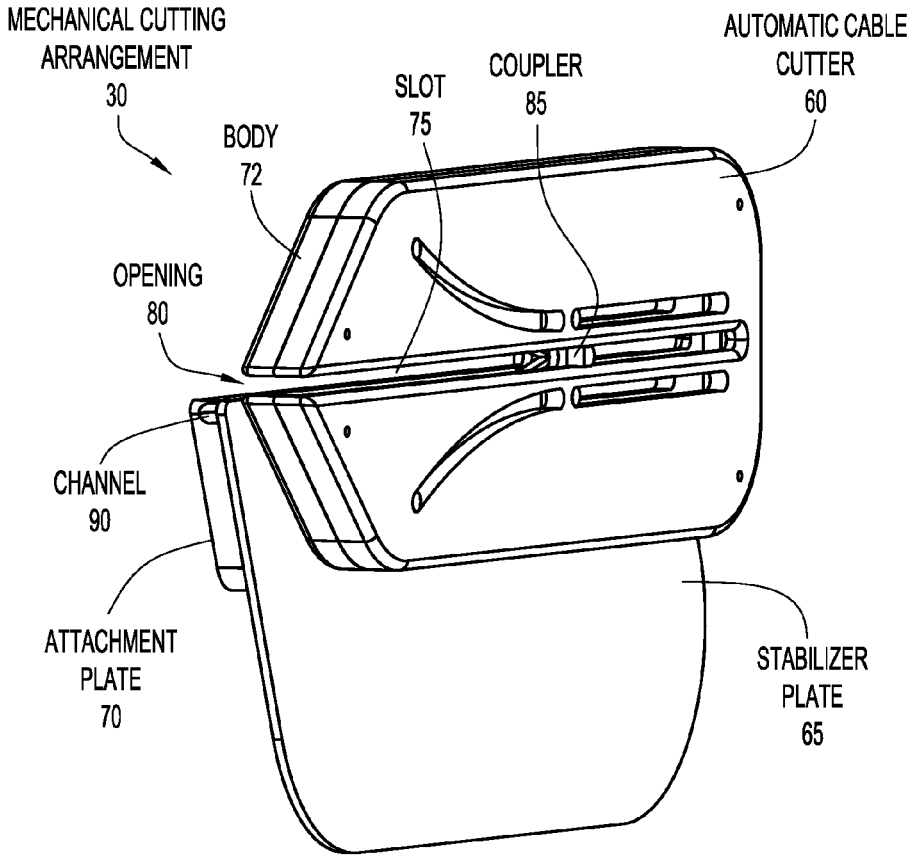
FIG. 2 is a perspective view of a mechanical cutting arrangement that comprises a self-resetting automatic cable cutter in accordance with embodiments presented herein.
Figure 3:
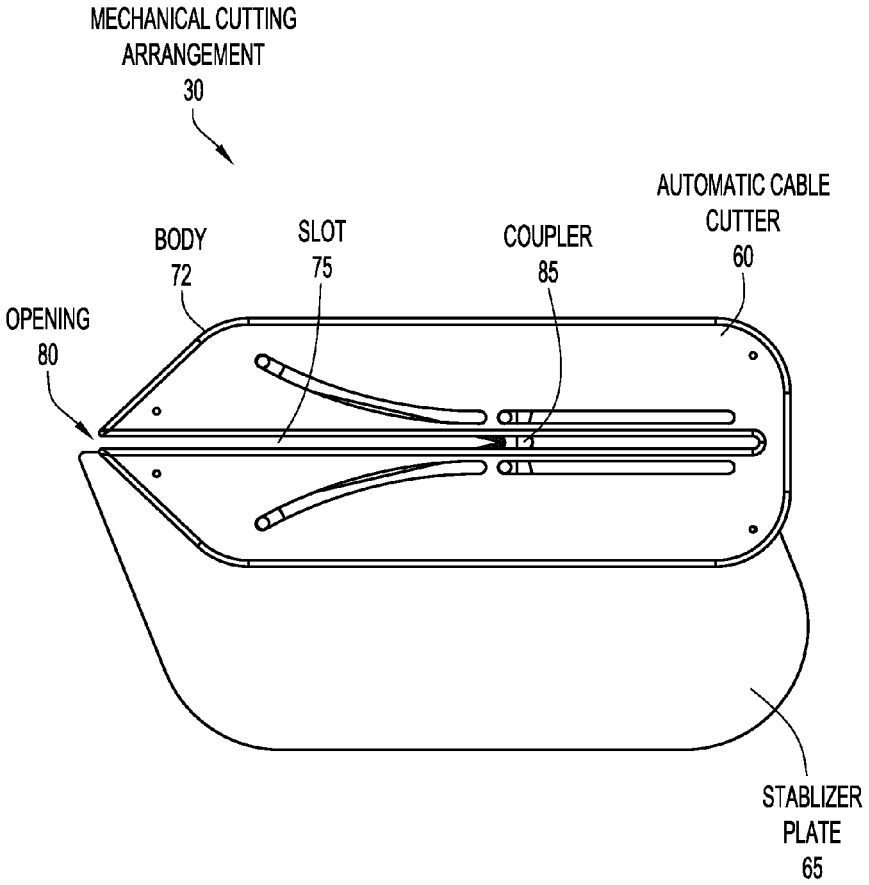
FIG. 3 is a top view of a mechanical cutting arrangement that comprises a self-resetting automatic cable cutter in accordance with embodiments presented herein.
Figure 4:
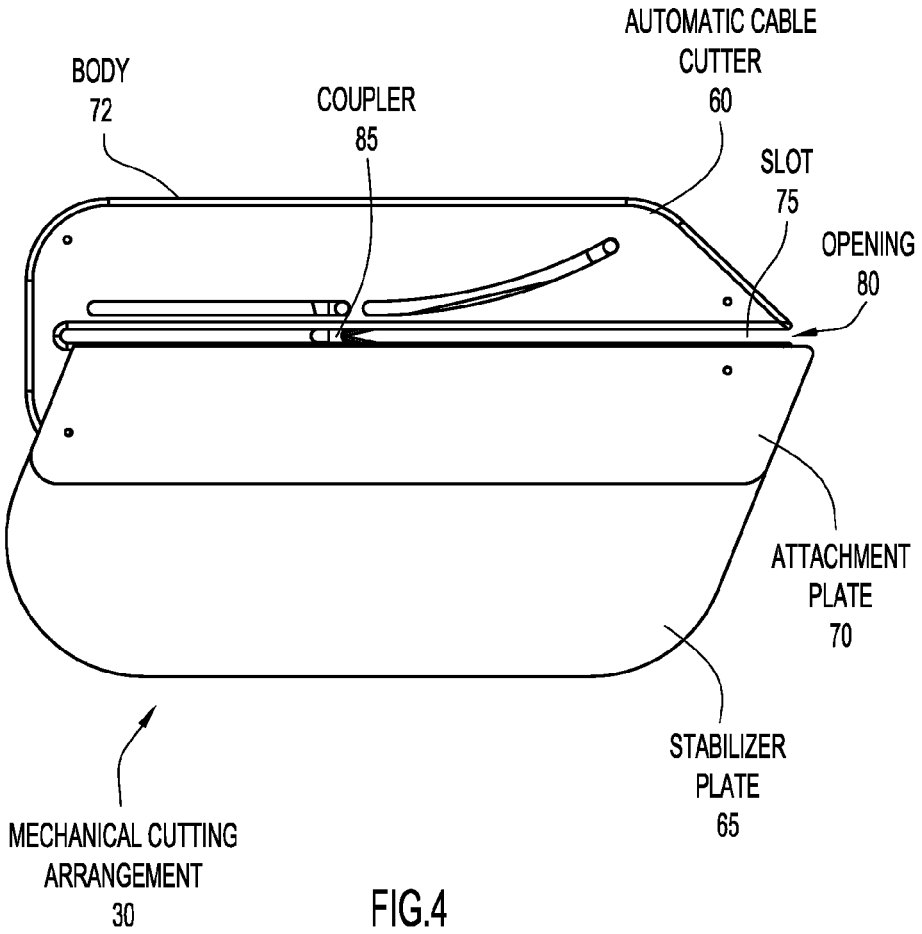
FIG. 4 is a bottom view of a mechanical cutting arrangement that comprises a self-resetting automatic cable cutter in accordance with embodiments presented herein.

FIG. 2 is a perspective of the mechanical cutting arrangement 30 that comprises a self-resetting automatic cable cutter in accordance with embodiments presented herein. FIGS. 3 and 4 are top and bottom views, respectively, of the mechanical cutting arrangement 30. It is to be understood that terms such as "left," "right," "top," "bottom," "front," "rear," "side," "height," "length," "width," "upper," "lower," "interior," "exterior," "inner," "outer," "forward," "rearward" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

As shown in FIGS. 2-4, the mechanical cutting arrangement 30 comprises a self-resetting automatic cable cutter 60, a stabilizer plate 65, and a sweep line attachment plate 70. The self-resetting automatic cable cutter 60 comprises an elongate body 72 that includes an elongate cable slot 75. The elongate cable slot 75 has an opening 80 configured to receive the mooring cable 50 therein.

As noted above, as the mechanical cutting arrangement 30 is towed through the water by the naval minesweeper 15, the mooring cable 50 will slide along sweep line 20 until it reaches the mechanical cutting arrangement 30. The mechanical cutting arrangement 30 is configured to steer the mooring cable 50 to the opening 80. If the mooring cable 50 is sufficiently small, the mooring cable 50 will enter the cable slot 75. However, if the mooring cable 50 has a thickness such that it cannot enter the cable 75 (i.e., too large to be cut by the automatic cable cutter 60), the mooring cable 50 is steered away form the opening and will bypass the mechanical cutting arrangement 30. In such cases, the mooring cable 50 may then be cut by a backup cutter (e.g., an explosive cutter).

In the embodiment of FIG. 2, the mooring cable 50 is sized so as to enter the cable slot 75 via opening 80. As a result of the movement of the mooring cable 50 relative to the sweep line 20 (and attached automatic cutter 30), the mooring cable 50 slides along the cable slot 75 through body 72. The mooring cable 50 is configured to contact and exert a force on the coupler 85. In response to this force, the coupler 85 is configured to slide in a direction away from the opening 80. That is, as the mooring cable 50 slides along the cable slot 75, the mooring cable 50 places a force on the coupler 85 that pushes the coupler 85 away from the opening 80.

As described in greater detail below, first and second slideable cutting assemblies (not shown in FIGS. 2-4) are positioned on opposing sides of the cable slot 75 and are mechanically connected to the coupler 85. The sliding of the coupler 85 in response to the cable force causes the first and second cutting assemblies to close together at the cable slot 75 to cut the mooring cable 50. That is, the tension of the mooring cable 50 provides the mechanical leverage to close the first and second cutting assemblies together that thereby cut the mooring cable.

As noted above, the mechanical cutting arrangement 30 also comprises the stabilizer plate 65 and the attachment plate 70. The stabilizer plate 65 is configured to use hydrodynamic drag to keep the cutter correctly oriented. The attachment plate 70 includes a channel 90 that is configured to be mounted over the sweep line 20 (FIG. 1) and the stabilizer plate 65. In other words, when the attachment plate 70 is mounted to the stabilizer plate 65, the sweep line 20 is disposed in the channel 90.

Figure 5:
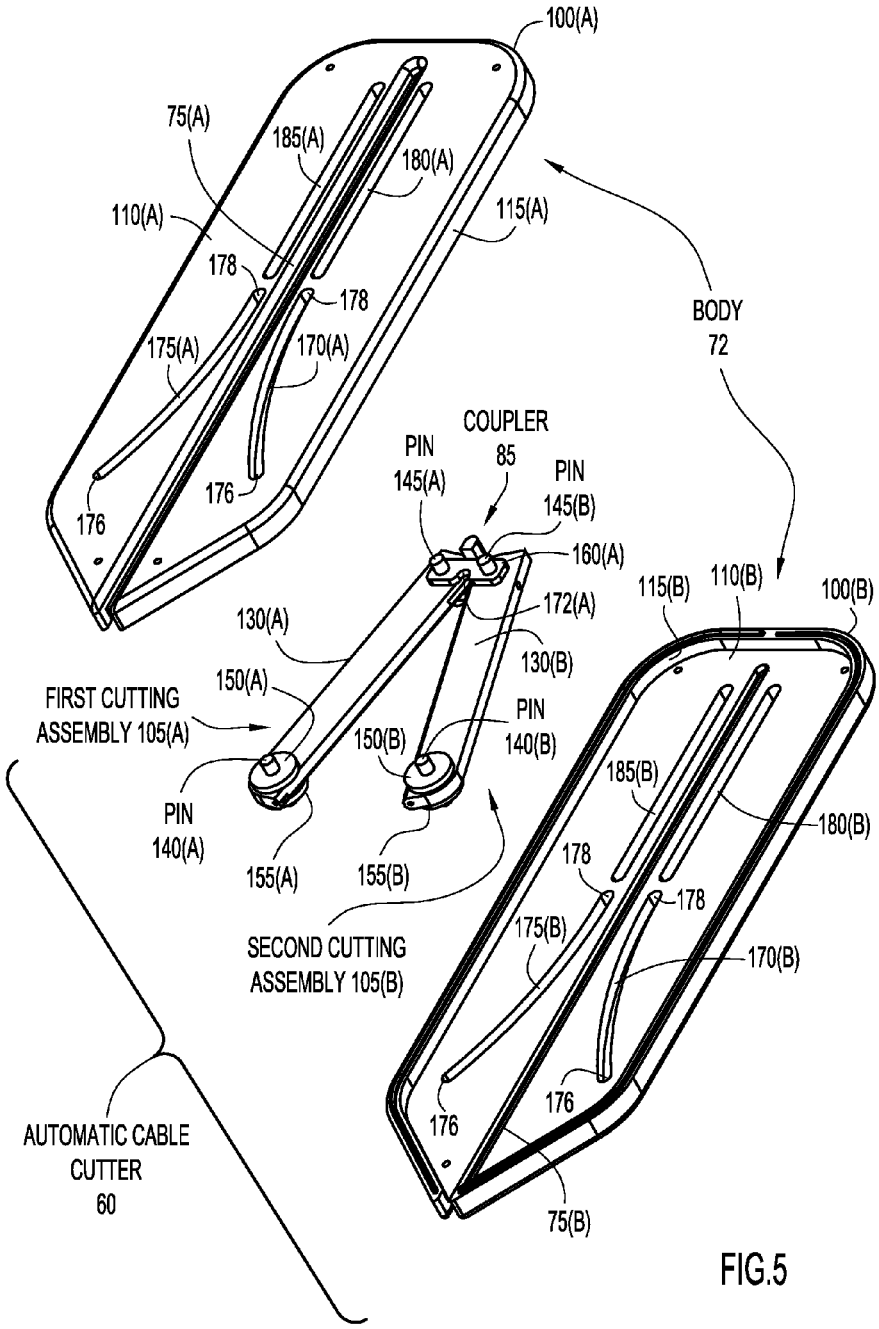
FIG. 5 is a partially exploded view of a self-resetting automatic cable cutter in accordance with embodiments presented herein.
Figure 6:
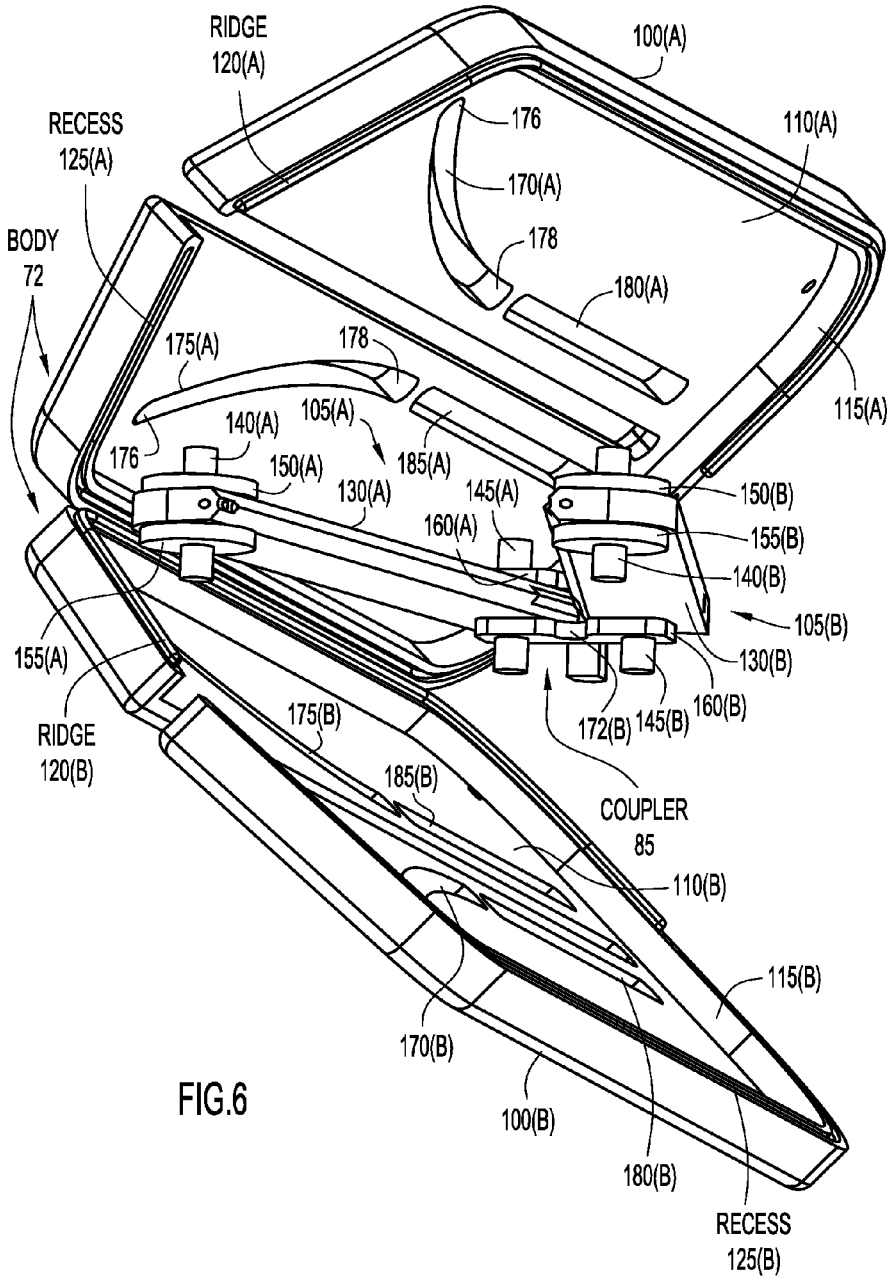
FIG. 6 is another partially exploded view of a self-resetting automatic cable cutter in accordance with embodiments presented herein.

FIGS. 5 and 6 are partially exploded views of the self-resetting automatic cable cutter 60. For ease of illustration, the stabilizer plate 65 and attachment plate 70 have been omitted from FIGS. 5 and 6.

Figure 7:
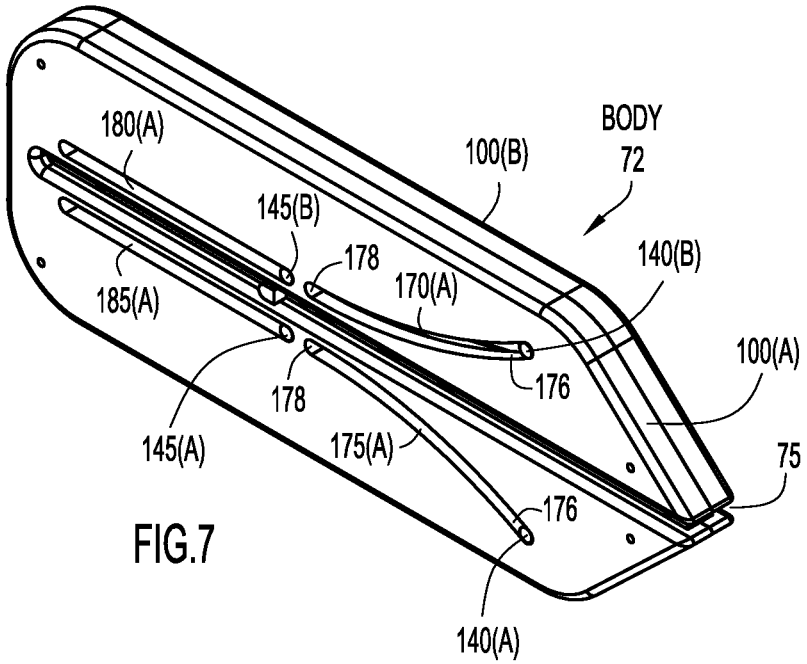
FIG. 7 is a perspective view of a self-resetting automatic cable cutter in accordance with embodiments presented herein.
Figure 8:
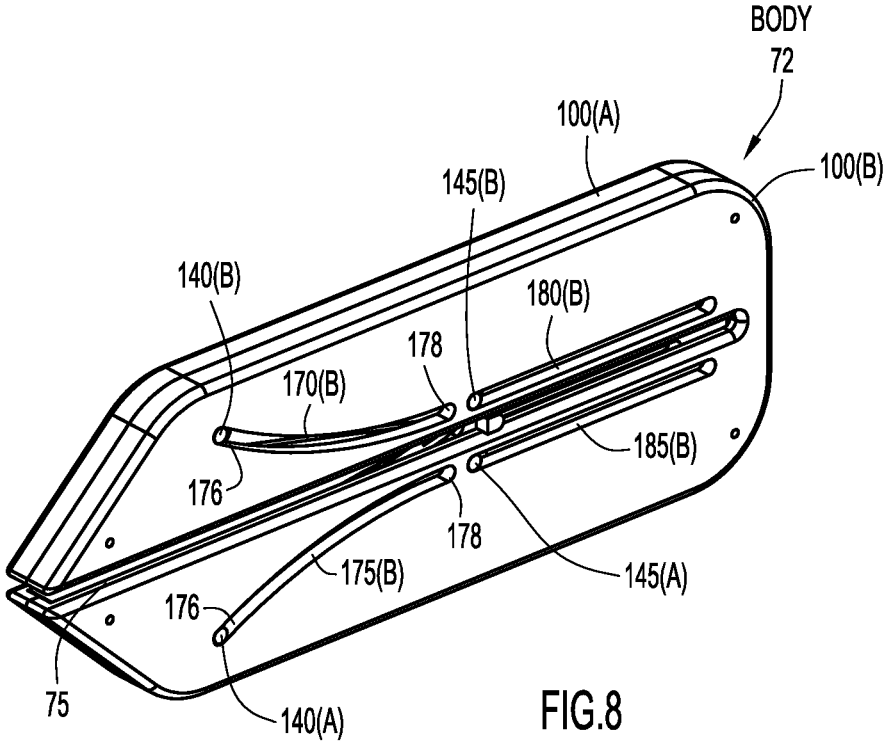
FIG. 8 is a perspective view of a self-resetting automatic cable cutter in accordance with embodiments presented herein.

The body 72 of the self-resetting automatic cable cutter 60 comprises first and second corresponding mating halves 100(A) and 100(B). The mating halves 100(A) and 100(B) are substantially symmetrical with one another and are configured to mate to form an interior cavity (not shown) in which a first slideable cutting assembly 105(A) and second slideable cutting assembly 105(B) are positioned. While FIG. 6 illustrates the interior of the first and second mating halves 100(A) and 100(B), FIGS. 7 and 8 are perspective views, respectively, illustrating the exterior of the first and second mating halves 100(A) and 100(B).

As shown in FIG. 6, the mating halves 100(A) and 100(B) each comprise a planar element 110(A) and 110(B), respectively, which form the top and bottom of the body 72. Extending from the planar elements 110(A) and 110(B) are respective sidewalls 115(A) and 115(B). In operation, the sidewalls 115(A) and 115(B) mate with one another to form the sides of the body 72, thereby resulting in an enclosure or shell in which the first cutting assembly 105(A) and second cutting assembly 105(B) are disposed.

As shown in FIG. 6, a first portion of the end of the sidewall 115(A) includes a ridge 120(A), while a second portion of the end of the sidewall 115(A) includes a recess 125(A). Similarly, a first portion of the end of the sidewall 115(B) includes a ridge 120(B), while a second portion of the end of the sidewall 115(B) includes a recess 125(B). When the mating halves 100(A) and 100(B) are joined together, the ridge 120(A) is configured to be inserted into the recess 125(B) and the ridge 120(B) is configured to be inserted into the recess 125(A). The ridges 120(A) and 120(B) and the corresponding recesses 125(A) and 125(B) provide structurally rigidity to the body 72 when the mating halves 100(A) and 100(B) are joined together. Although not shown, a plurality of screws or other fastening mechanisms may be used to attach the mating halves 100(A) and 100(B) together.

As noted above, the body 72 includes an elongate cable slot 75 that extends through a length of the body. The cable slot 75 is formed by two cable slot halves 75(A) and 75(B) disposed in the mating halves 100(A) and 100(B), respectively. That is, when the mating halves 100(A) and 100(B) are joined together, the cable slot halves 75(A) and 75(B) are aligned with one another to form the cable slot 75.

The cable slot 75 is configured to receive (via opening 80) the mooring cable 50. In operation, the first cutting assembly 105(A) and second cutting assembly 105(B) are positioned in the body 72 on opposing sides of the cable slot 75. The first cutting assembly 105(A) comprises a cutting bar 130(A) that includes first and second openings (not shown) through which pins 140(A) and 145(A) extend. As described further below, the first cutting assembly 105(A) is pivotally coupled to pin 145(A). Disposed around the pin 140(A) on opposing sides of the cutting bar 130(A) are washers 150(A) and 155(A). Similarly, the second cutting assembly 105(B) comprises a cutting bar 130(B) that includes first and second openings (not shown) through which pins 140(B) and 145(B) extend. As described further below, the second cutting assembly 105(B) is pivotally coupled to pin 145(B). Disposed around the pin 140(B) on opposing sides of the cutting bar 130(B) are washers 150(B) and 155(B).

The first and second cutting assemblies 105(A) and 105(B) are connected by the coupler 85. The coupler 85 comprises first and second fastening plates 160(A) and 160(B) disposed on opposing sides of the cutting bars 130(A) and 130(B). The fastening plates 160(A) and 160(B) each include first and second openings (not shown) through which pins 145(A) and 145(B) extend. The fastening plates 160(A) and 160(B) each include a notch 172(A) and 172(B), respectively.

As shown in FIGS. 5-8, the mating halves 100(A) and 100(B) each include four channels/slot halves in addition to the cable slot half 75(A) and 75(B), respectively. In particular, the mating half 100(A) includes two cam slot halves 170(A) and 175(A) and two longitudinal slot halves 180(A) and 185(A). The cam slots 170(A) and 175(A) have reciprocal curved (arced) shapes. That is, the cam slot halves 170(A) and 175(A) each have a first end 176 that is positioned close to the outer edges (sidewalls) of the body 72. From the first ends 176, the cam slot halves 170(A) and 175(A) curve towards one another at second ends 178 that are positioned adjacent to the center of the body 72. Longitudinal slot halves 180(A) and 185(A) are generally straight and are aligned with the second ends 178 of the cam slot halves 170(A) and 175(A).

The mating half 100(B) also includes two cam slot halves 170(B) and 175(B) and two longitudinal slot halves 180(B) and 185(B). The cam slot halves 170(B) and 175(B) have reciprocal curved (arced) shapes. That is, the cam slot halves 170(B) and 175(B) each have a first end 176 that is positioned close to the outer edge (sidewalls) of the body 72. From the first ends 176, the cam slot halves 170(B) and 175(B) curve towards one another at second ends 178 that are positioned adjacent to the center of the body 72. Longitudinal slot halves 180(B) and 185(B) are generally straight and are aligned with the second ends 178 of the cam slot halves 170(B) and 175(B).

When the mating halves 100(A) and 100(B) are joined together, the cam slot halves and longitudinal slot halves in one mating half are configured to align with a corresponding cam slot half or longitudinal slot half in the other mating half More specifically, the cam slot halves 170(A) and 170(B) align with one another to form a cam slot 170, while the cam slot halves 175(A) and 175(B) align with one another to form a cam slot 175. Similarly, the longitudinal slot halves 180(A) and 180(B) align with one another to form a longitudinal slot 180, while the cam slot halves 185(A) and 185(B) align with one another to form a cam slot 185.

As shown in FIGS. 7 and 8, when the body 72 is closed, the ends of the pins 140(A), 140(B), 145(A), and 145(B) are positioned in and configured to slide along the cam or longitudinal slots. More specifically, one end of pin 140(B) is positioned in cam slot half 170(A) while the other end of pin 140(B) is positioned in cam slot half 170(B). Similarly, one end of pin 140(A) is positioned in cam slot half 175(A) while the other end of pin 140(A) is positioned in cam slot half 175(B). Furthermore, one end of pin 145(B) is positioned in cam slot half 180(A) while the other end of pin 145(B) is positioned in cam slot half 180(B). Finally, one end of pin 145(A) is positioned in cam slot half 185(A) while the other end of pin 145(A) is positioned in cam slot half 185(B). As described further below, the pins 140(A), 140(B), 145(A), and 145(B) slide along their respective slots so as to enable the self-resetting automatic cable cutter 60 to cut cable 50 when it is positioned in cable slot 75.

FIGS. 9A-9D are a sequence of top views of the first and second cutting assemblies 105(A) and 105(B) illustrating the movement of the cutting assemblies to cut mooring cable 50. The first and second cutting assemblies 105(A) and 105(B) are shown mounted to first mating half 100(A). For ease of illustration, the second mating half 100(B) and the mooring cable 50 has been omitted from FIGS. 9A-9D.

Figure 9B:
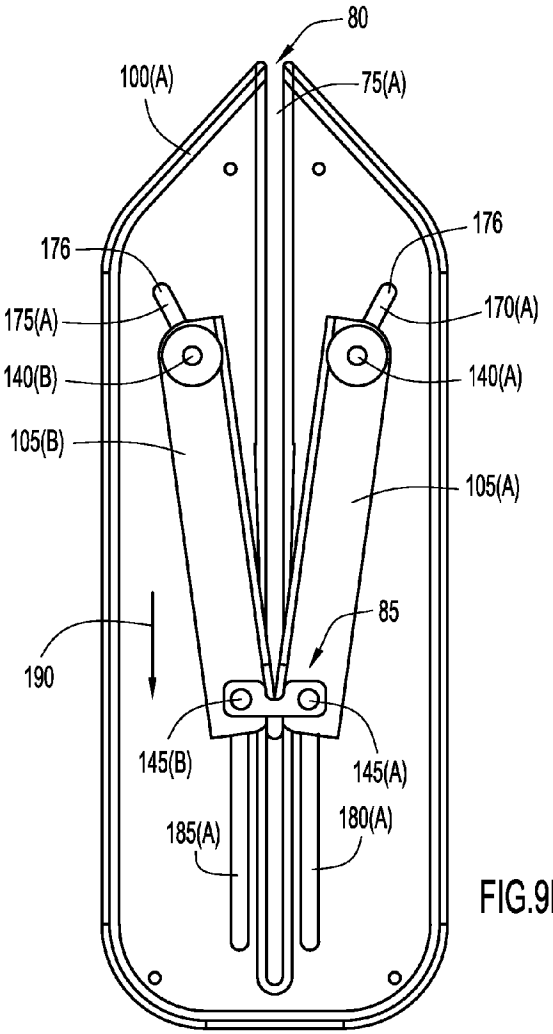
FIGS. 9A-9D are a sequence of top views illustrating the cutting operation of a self-resetting automatic cable cutter in accordance with embodiments presented herein.
Figure 9A:
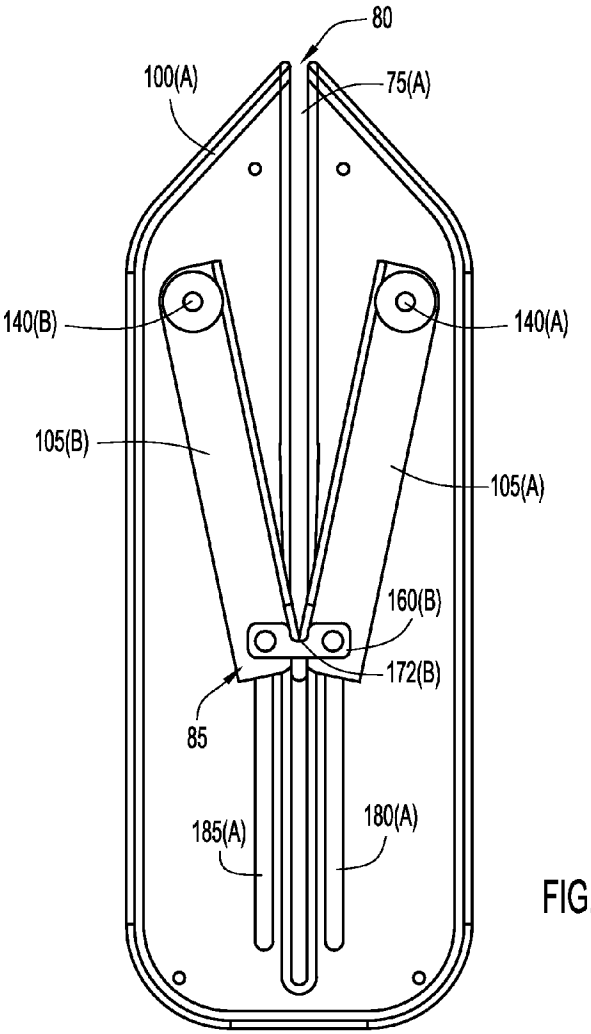

FIG. 9A illustrates the first and second cutting assemblies 105(A) and 105(B) in a fully open configuration. In this configuration, the pins 140(A) and 140(B) are positioned at the first ends 176 of the cam slots 170 and 175, respectively.

The mooring cable 50 enters the cable slot 75 through opening 80. Due to the motion of the mechanical cutting arrangement 30 (FIG. 1) as it is towed through the water relative to the fixed position of the mooring cable 50, the mooring cable 50 slides along cable slot 75 until it reaches the coupler 85. In particular, the mooring cable 50 will slide along the cable slot 75 and seat in the notches 172(A) (FIG. 5)

and 172(B) of fastening plates 160(A) (FIG. 5) and 160(B). In other words, as a result of the movement of the mooring cable 50 relative to the sweep line 20 (and attached automatic cutter 30), the mooring cable 50 slides along the cable slot 75 through body 72 to coupler 85.

As shown in FIG. 9B, the motion of the mechanical cutting arrangement 30 relative to the mooring cable 50 also causes the mooring cable to exert a force on the coupler 85 that causes the coupler 85 to move in the direction shown by arrow 190 (i.e., in a direction away from opening 80). The force placed on coupler 85 causes pins 140(A) and 140(B), which are mechanically connected to the coupler 85, to slide along cam slots 170 and 175, respectively, in the general direction shown by arrow 190 (i.e., away from opening 80). Similarly, the force placed on coupler 85 also causes pins 145(A) and 145(B), which are also mechanically connected to the coupler, to slide along longitudinal slots 180 and 185, respectively, again in the general direction shown by arrow 190.

Figure 9D:
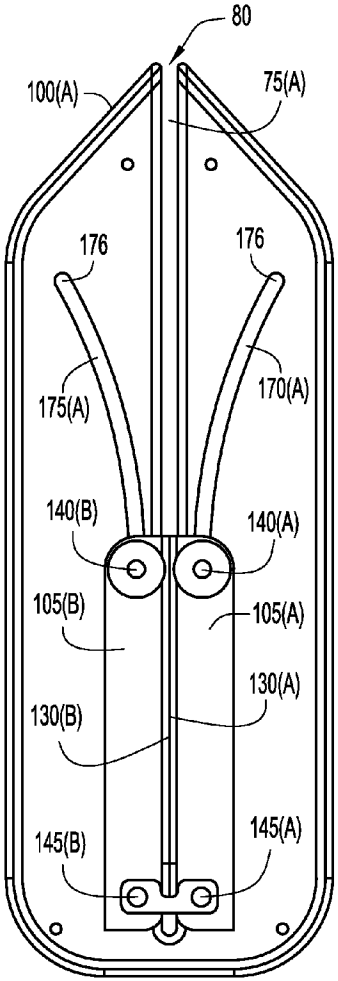
Figure 9C:
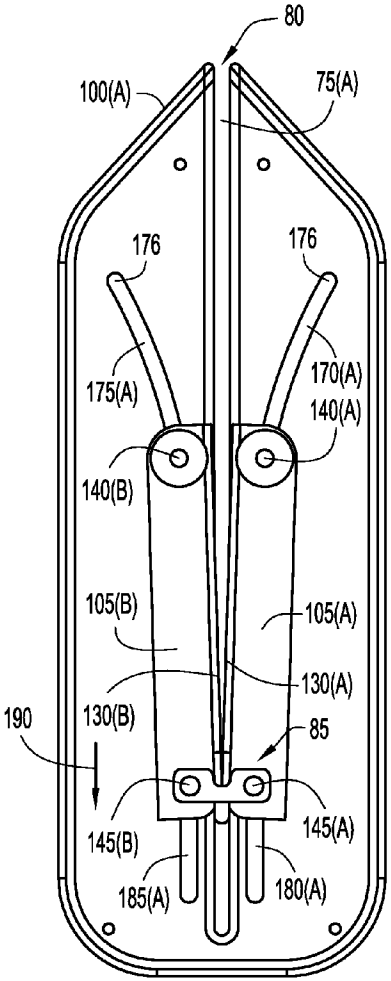

As shown in FIGS. 9C and 9D, the mooring cable 50 continues to place a force on coupler 85 causing movement of coupler 85 along cable slot 75 away from opening 80 (i.e., in the direction shown by arrow 190). As noted above, the longitudinal slots 180 and 185 are generally straight and the pins 145(A) and 145(B) move parallel to cable slot 75. However, due to the curvature of cam slots 170 and 175, as the coupler 85 moves away from the opening 80, the cutting bars 130(A) and 130(B) will pivot about pins 145(A) and 145(B), respectively, such that the ends of the cutting bars near pins 140(A) and 140(B) converge (i.e., move towards one another to close like scissors). When the pins 140(A) and 140(B) reach the ends 178 of the cam slots 170 and 175, the first and second cutting assemblies 105(A) and 105(B) are in a fully closed configuration where the cutting bars 130(A) and 130(B) are substantially parallel and abutting.

As noted above, the mooring cable 50 is positioned in cable slot 75 and places force on the coupler 85 that pushes the coupler 85 away from opening 80. As the cutting bars 130(A) and 130(B) close in response to the movement of coupler 85, the cutting bars 130(A) and 130(B) will cut the mooring cable 50 positioned in the cable slot 75. As such, the mooring cable 50 provides the mechanical leverage that causes the cutting bars 130(A) and 130(B) to close and cut the cable. In practice, the curved shape of the cam slots 170 and 175 provide increasing mechanical advantage as the cutting bars 130(A) and 130(B) close (i.e., the mechanical force increases as the cutting bars get closer together).

In accordance with embodiments presented herein, the self-resetting automatic cable cutter 60 is also configured to be self-resetting (i.e., biased to an open configuration). That is, after the mooring cable 50 is cut, the first and second cutting assemblies 105(A) and 105(B) are configured to return to the open configuration shown in FIG. 9A. In this way, the self-resetting automatic cable cutter 60 automatically returns to a configuration that is ready to cut any subsequent mooring cables encountered by the naval mine sweeping system 10.

Figure 10B:
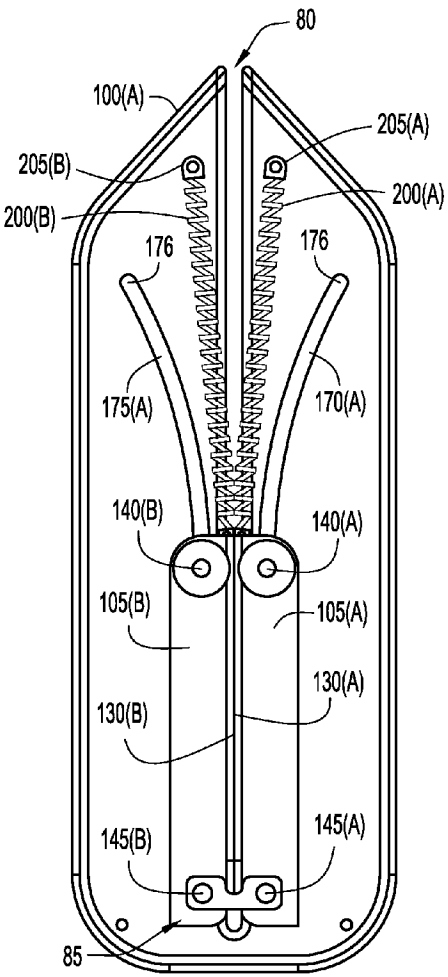
FIGS. 10A and 10B are a sequence of top views illustrating the self-resetting operation of a self-resetting automatic cable cutter in accordance with embodiments presented herein.
Figure 10A:
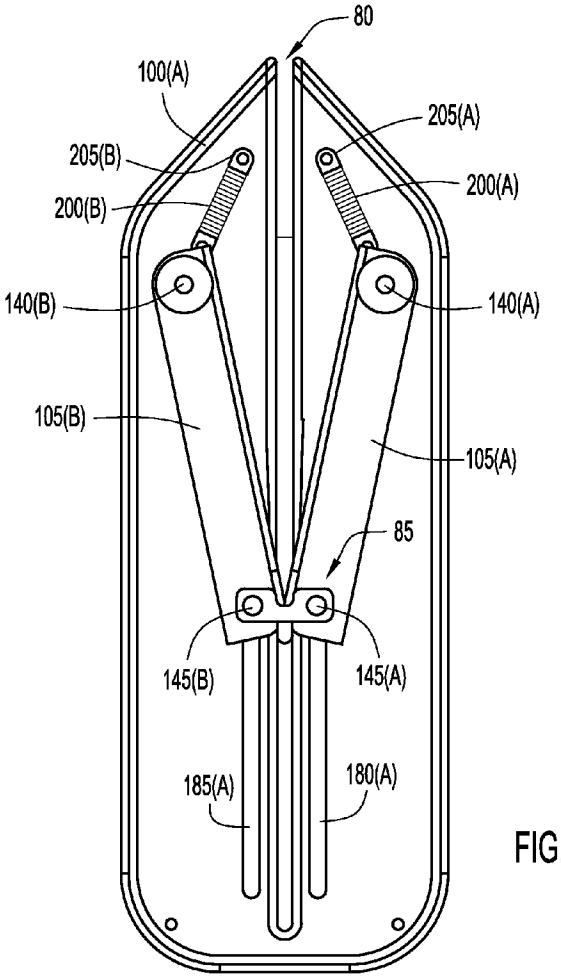

In certain embodiments, the self-resetting capability of self-resetting automatic cable cutter 60 is provided by internal reset springs that are biased to pull the first and second cutting assemblies 105(A) and 105(B) back to the open configuration. FIGS. 10A and 10B are top views of the first and second cutting assemblies 105(A) and 105(B) mounted to first mating half 100(A) that illustrate the self-resetting capability of the self-resetting automatic cable cutter 60. FIG. 10A illustrates the first and second cutting assemblies 105(A) and 105(B) in the open configuration, while FIG. 10B illustrates the first and second cutting assemblies 105(A) and 105(B) in the closed configuration.

As shown in FIGS. 10A and 10B, reset springs 200(A) and 200(B) are attached to the first and second cutting assemblies 105(A) and 105(B), respectively. The reset springs 200(A) and 200(B) extend from the first and second cutting assemblies 105(A) and 105(B), respectively, to connector posts 205(A) and 205(B), respectively.

The reset springs 200(A) and 200(B) are helical extension springs that are configured to operate with a tension load (i.e., the reset springs stretch as a load is applied). As shown in FIG. 10A, when the first and second cutting assemblies 105(A) and 105(B) are in the open configuration, the reset springs 200(A) and 200(B) are in an unloaded state. However, as the mooring cable 50 causes the first and second cutting assemblies 105(A) and 105(B) to slide away from opening 80 (via the force applied on coupler 85), the reset springs 200(A) and 200(B) are extended. During this extension, the reset springs 200(A) and 200(B) absorb and store energy (i.e., the springs are placed in tension). When the cutting bars 130(A) and 130(B) cut the mooring cable 50, the force on the coupler 85, and thus the tension on reset springs 200(A) and 200(B), is removed. As such, the reset springs 200(A) and 200(B) will return to the unloaded state, thereby providing a return force that pulls the cutting assemblies 105(A) and 105(B) back to the open configuration. That is, the return force provided by the reset springs 200(A) and 200(B) causes the pins 140(A) and 140(B) to slide along slots 170 and 175, respectively, towards ends 176. Similarly, the return force provided by the reset springs 200(A) and 200(B) causes the pins 145(A) and 145(B) to slide along slots 180 and 185, respectively, in the direction of opening 180. The initial tension (i.e., the force that keeps the coils of an extension spring closed and which must be overcome before coils start to open) on the reset springs 200(A) and 200(B) is such that the pins 140(A) and 140(B) will seat against the cam slot wall at the ends 176 of the cam slots 170 and 175, respectively.

The mooring cable 50 is cut in the cable slot 75 via closure of the cutting bars 130(A) and 130(B). In operation, the mooring cable 50 is cut where the cutting bars 130(A) and 130(B) first close together adjacent to coupler 85. In certain embodiments, the cutting bars 130(A) and 130(B) include hardened inserts that perform the actual cutting of the mooring cable 50 in response to the leverage provided by the tension of the mooring cable as it moves along the cable slot 75.

Figure 11:
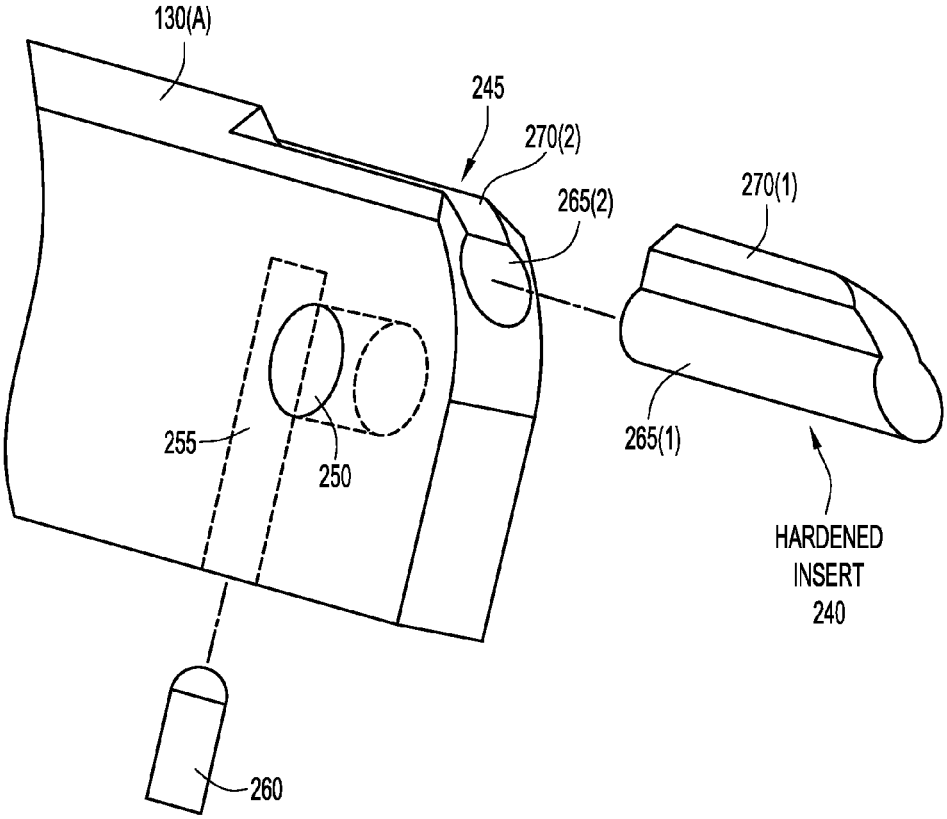
FIG. 11 is a perspective view illustrating a hardened insert that may be part of a self-resetting automatic cable cutter in accordance with embodiments presented herein.

FIG. 11 is a perspective view of the end of cutting bar 130(A) that illustrates a hardened insert 240. The cutting bar 130(A) includes a channel 245 that is shaped to receive the hardened insert 240. The channel 245 is in the end of the cutting bar 130(A) that includes an opening 250 through which pin 145(A) is configured to be inserted. The cutting bar 130(A) also includes an aperture 255 that is configured to receive a set screw 260. The aperture 255 and a portion of the opening 250 are shown using dotted lines to reflect that these portions are inside the cutting bar 130(A).

When the hardened insert 240 is positioned in channel 245, the set screw 260 is inserted into aperture 255 to retain the hardened insert 240 in the channel 245. The channel 245 and hardened insert 240 may also have corresponding shapes that assist in retaining the hardened insert in the channel. In the example of FIG. 11, the hardened insert 240 and the channel 245 have relatively thicker lower sections 265(1) and 265(2), respectively, and relatively thinner upper sections 270(1) and 270(2), respectively.

The hardened insert 240 is, for example, a carbide insert. The hardened insert 240 provides the hardness needed to cut the mooring cable 50, but also provides the ability to be replaced without having to replace the entire cutting bar 130 (A).

FIGS. 2-11 illustrate one arrangement for a self-resetting automatic cable cutter in accordance with embodiments presented herein. It is to be appreciated that the arrangement of FIGS. 2-11 is merely illustrative and other variations are possible. For example, FIG. 12 illustrates a variation of a self-resetting automatic cable cutter 360 that has a different shape that that shown in FIGS. 2-11.

Figure 12:
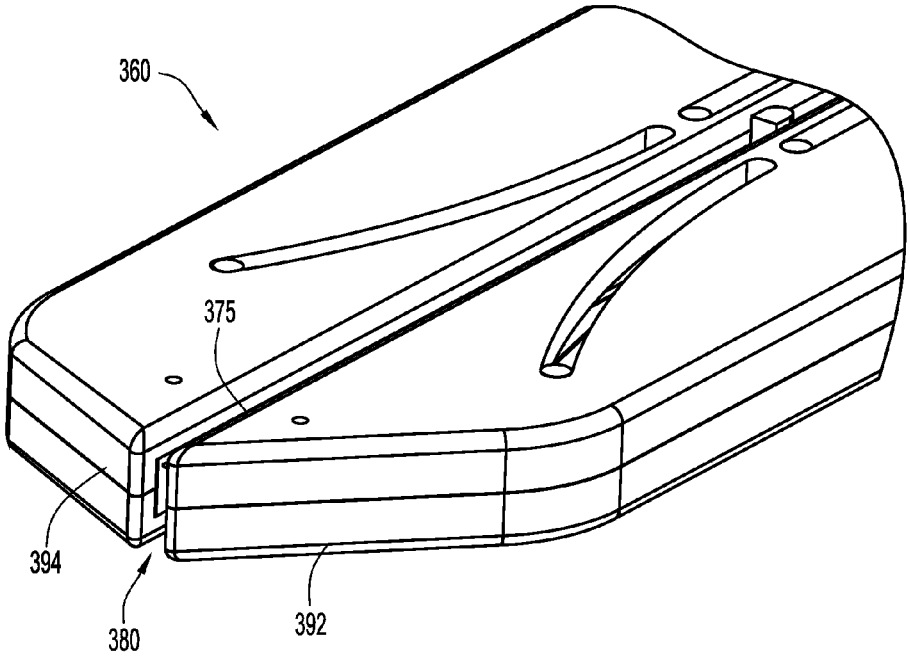
FIG. 12 is a perspective view of a portion of a self-resetting automatic cable cutter in accordance with embodiments presented herein.

In particular, the self-resetting automatic cable cutter 360 of FIG. 12 includes a cable slot 375 that terminates in opening 380. Adjacent to one side of the opening 380 is an angled surface 392, while adjacent to the other side of the opening is an orthogonal surface 394. That is, surface 392 is angled relative to cable slot 375, while surface 394 is generally orthogonal to cable slot 375. In operation, a mooring cable slides along the angled surface 392 until it reaches opening 380. If the mooring cable is smaller than the opening 380, the cable will enter elongate slot 375. However, if the mooring cable is larger than the opening 380, the cable will slide along orthogonal surface 394 and move past the self-resetting automatic cable cutter 360.

Figure 13:
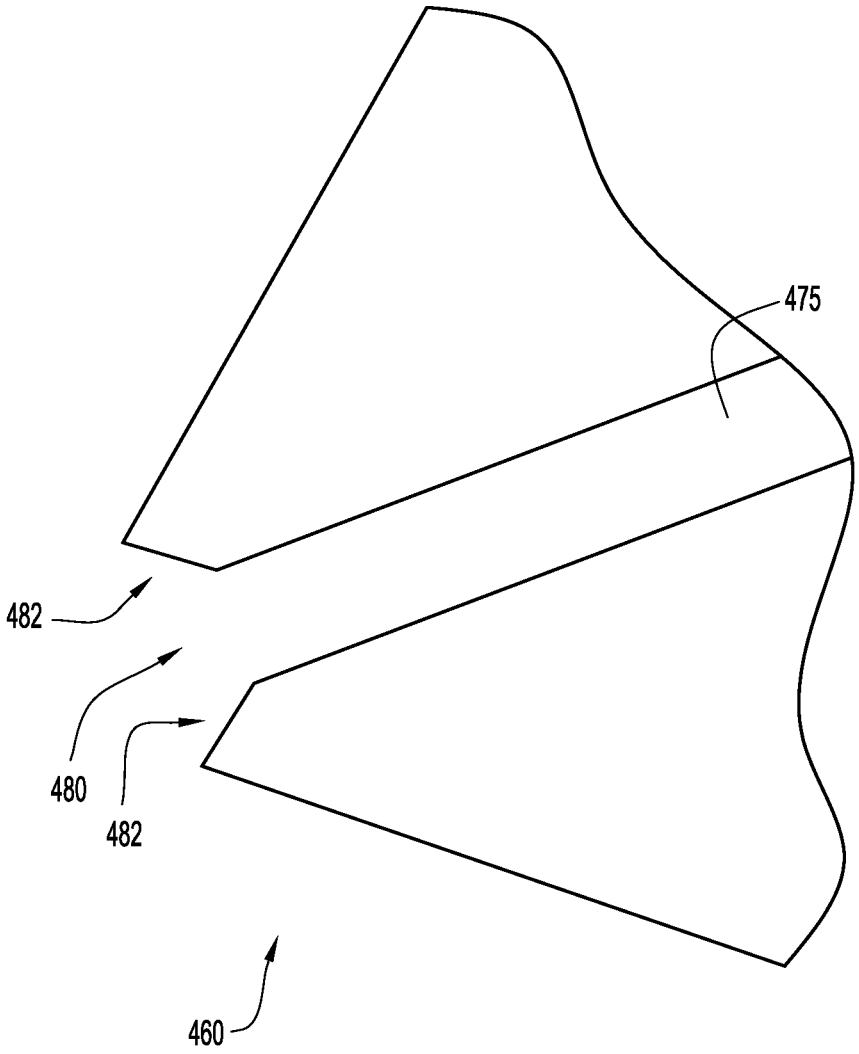
FIG. 13 is a top view of a portion of a self-resetting automatic cable cutter in accordance with embodiments presented herein.

FIG. 13 illustrates another variation where the ends of the cable slot are beveled. More specifically, the self-resetting automatic cable cutter 460 of FIG. 13 includes a cable slot 475. The opening 480 is bounded by beveled surfaces 482 that operate to direct/steer a mooring cable into the cable slot 475.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

What is claimed is:

1. A self-resetting automatic cable cutter, comprising:
an elongate body;
an elongate cable slot extending along a length of the body and having an opening bounded by beveled surfaces configured to receive a cable therein such that the cable is able to slide along the cable slot;
first and second cutting assemblies disposed on opposing sides of the cable slot; and
a coupler disposed across the cable slot, wherein the coupler mechanically connects to the first and second cutting assemblies and is configured to slide away from the opening in response to force applied by the cable,
wherein sliding of the coupler away from the opening causes the first and second cutting assemblies to close together to cut the cable positioned in the cable slot.

2. The self-resetting automatic cable cutter of claim 1, further comprising:
first and second cam slots disposed in the body; and
first and second longitudinal slots disposed in the body;
wherein the first cutting assembly is configured to slide along the first cam slot and the first longitudinal slot, and wherein the second cutting assembly is configured to slide along the second cam slot and the second longitudinal slot.

3. The self-resetting automatic cable cutter of claim 2, wherein the first and second cam slots have reciprocal curved shapes such that the first and second cam slots have first ends positioned adjacent to outer walls of the body and second ends positioned adjacent to the center of the body.

4. The self-resetting automatic cable cutter of claim 2, wherein the first cutting assembly includes a pin slideably disposed in the first cam slot and the a pin slideable disposed in the first longitudinal slot, and wherein the second cutting assembly includes a pin slideably disposed in the second cam slot and the a pin slideable disposed in the second longitudinal slot.

5. The self-resetting automatic cable cutter of claim 1, further comprising:
a first reset spring connected to the first cutting assembly; and
a second reset spring connected to the second cutting assembly,
wherein after the cable is cut the first and second reset springs are configured to cause movement of the coupler in the direction of the opening so as to open the first and second cutting assemblies.

6. The self-resetting automatic cable cutter of claim 1, wherein the first and second cutting assemblies each comprise:
a cutting bar that includes a replaceable hardened insert.

7. A system, comprising:
a sweep line configured to engage a mooring cable; and
a self-resetting automatic cable cutter disposed on the sweep line so as to move relative to the mooring cable and comprising:
an elongate body,
first and second cutting bars disposed within the elongate body,
an elongate cable slot extending along a length of the body between the first and second cutting bars and having an opening configured to receive the mooring cable therein such that the mooring cable is able to slide along the cable slot; and
a coupler disposed across the cable slot, wherein the coupler mechanically connects to the first and second cutting bars,
wherein the self-resetting automatic cable cutter is configured to receive the mooring cable therein and to use the movement relative to mooring cable to slide the coupler away from the opening to provide mechanical leverage that closes the first and second cutting bars together so as to cut the mooring cable.

8. The system of claim 7, further comprising:
first and second cam slots disposed in the body; and
first and second longitudinal slots disposed in the body;
wherein the first cutting bar is part of a first cutting assembly that is configured to slide along the first cam slot and the first longitudinal slot, and wherein the second cutting bar is part of a second cutting assembly that is configured to slide along the second cam slot and the second longitudinal slot.

9. The system of claim 8, wherein the first and second cam slots have reciprocal curved shapes such that the first and second cam slots have first ends positioned adjacent to outer walls of the body and second ends positioned adjacent to the center of the body.

10. The system of claim 8, wherein the first cutting assembly includes a pin slideably disposed in the first cam slot and the a pin slideable disposed in the first longitudinal slot, and wherein the second cutting assembly includes a pin slideably disposed in the second cam slot and the a pin slideable disposed in the second longitudinal slot.

11. The system of claim 7, further comprising:

first and second reset springs connected to the first and second cutting assemblies, respectively, configured to cause movement of the coupler in the direction of the opening after the mooring cable is cut so as to open the first and second cutting assemblies.

12. The system of claim 7, further comprising:

an adjuster disposed on the sweep line and configured to control an orientation of the sweep line.

13. A self-resetting automatic cable cutter, comprising:

a body having first and second cam slots and first and second longitudinal slots;

an elongate cable slot disposed in the body and including an opening configured to enable the cable to slide through a portion of the body;

first and second slideable cutting assemblies disposed around the elongate cable slot and having first and second ends, the first cutting assembly being configured to slide along the first cam slot and the first longitudinal slot, and the second cutting assembly being configured to slide along the second cam slot and the second longitudinal slot; and a coupler attached to the second ends of the first and second cutting assemblies;

wherein the coupler is configured receive a force from a cable disposed in the cable slot that causes sliding movement of the first and second cutting assemblies such that the first ends of the cutting assemblies follow a curved path resulting in closure of the first and second cutting assemblies that sever the cable sliding along the cable slot.

14. The self-resetting automatic cable cutter of claim 13, wherein the coupler is configured to slide away from the opening in response to force applied by the cable and wherein the sliding of the coupler away from the opening causes the sliding movement of first and second cutting assemblies to close together to cut the cable positioned in the cable slot.

15. The self-resetting automatic cable cutter of claim 14, further comprising:

a first reset spring connected to the first cutting assembly; and a second reset spring connected to the second cutting assembly, wherein after the cable is cut the first and second reset springs are configured to cause movement of the coupler in the direction of the opening so as to open the first and second cutting assemblies.

16. The self-resetting automatic cable cutter of claim 13, wherein the first and second cam slots have reciprocal curved shapes such that the first and second cam slots have first ends positioned adjacent to outer walls of the body and second ends positioned adjacent to the center of the body.

17. A self-resetting automatic cable cutter, comprising:

an elongate body;

an elongate cable slot extending along a length of the body and having an opening configured to receive a cable therein such that the cable is able to slide along the cable slot;

first and second cutting assemblies disposed on opposing sides of the cable slot, the first and second cutting assemblies including a cutting bar that contains a replaceable hardened insert; and a coupler disposed across the cable slot, wherein the coupler mechanically connects to the first and second cutting assemblies and is configured to slide away from the opening in response to force applied by the cable, wherein sliding of the coupler away from the opening causes the first and second cutting assemblies to close together to cut the cable positioned in the cable slot.

* * * * *